US007507884B2

(12) United States Patent
Carlson

(10) Patent No.: US 7,507,884 B2
(45) Date of Patent: Mar. 24, 2009

(54) TEXTURED SOUND GENERATING PANELS HAVING INCREASED EFFICIENCY IN CONVERTING VIBRATIONAL ENERGY TO SOUND WAVES

(76) Inventor: Joseph W. Carlson, 1243 W. 3040 N., Pleasant Grove, UT (US) 84062

( * ) Notice: Subject to any disclaimer, the term of this patent is extended or adjusted under 35 U.S.C. 154(b) by 786 days.

(21) Appl. No.: 10/765,234

(22) Filed: Jan. 26, 2004

(65) Prior Publication Data

US 2004/0154862 A1 Aug. 12, 2004

Related U.S. Application Data

(60) Provisional application No. 60/442,915, filed on Jan. 25, 2003.

(51) Int. Cl.
*G10C 3/06* (2006.01)

(52) U.S. Cl. ..... 84/192; 84/291

(58) Field of Classification Search ..... 84/192, 84/291, 193

See application file for complete search history.

(56) References Cited

U.S. PATENT DOCUMENTS 4,031,798 A * 6/1977 Sidner ..... 84/291
4,821,839 A 4/1989 D'Antonio et al.
5,072,642 A * 12/1991 Imagawa ..... 84/193
5,401,921 A 3/1995 D'Antonio et al.
5,969,301 A 10/1999 Cullum, Jr. et al.
6,639,135 B1 * 10/2003 Lucas ..... 84/291

FOREIGN PATENT DOCUMENTS

KR 2002004285 A * 1/2002

* cited by examiner

*Primary Examiner*—Walter Benson
*Assistant Examiner*—Jianchun Qin
(74) *Attorney, Agent, or Firm*—Angus C. Fox, III

(57) ABSTRACT

I have discovered a way to improve the sound of musical instruments that utilize a soundboard or sound generating surface such as found in stringed musical instruments. I accomplished this by establishing a pronounced textured acoustical diffusing surface to one or more of the overall surfaces of the vibrating sound generating surface or soundboard of a stringed musical instrument creating greater surface area from which to generate greater acoustic energy. The result-compared to existing methods of improving the performance of soundboards of stringed musical instruments-is improved volume, timbre, projection, and tonality and sustain of the acoustical sounds produced by the stringed musical instrument.

39 Claims, 10 Drawing Sheets

TEXTURED SOUND GENERATING PANELS HAVING INCREASED EFFICIENCY IN CONVERTING VIBRATIONAL ENERGY TO SOUND WAVES

RELATED U.S. APPLICATION DATA

This application has a priority date based on Provisional Patent Application No. 60/442,915 filed Jan. 25, 2003.

BACKGROUND OF THE INVENTION

1. Field of the Invention

This invention relates to stringed musical instrument soundboards and, more particularly, to wood soundboards and methods for increasing the resonance thereof. The invention also relates to wood grain compaction techniques.

2. Definitions

Acoustic shall mean for the purposes of the present invention, as relating to sound, non-electronically generated and amplified sound generated by stringed musical instruments. An example of this terminology usage is an acoustic guitar versus an electric guitar.

Diffusion shall be used interchangeably and synonymously with and to mean launching, generation, transmission and active dispersion of sounds including secondary passive or active reflecting and active rediffusion of sounds after diffusion.

Soundboard shall mean a resonating structure directly or indirectly attached to vibrating strings in a stringed instrument to generate and diffuse sound.

Stringed instrument shall mean all musical instruments having strings and soundboards that are strummed, plucked, hammered, struck, or bowed.

Surface shall mean for purposes of the present invention all or part of the sounding surface of a stringed musical instrument to which the present invention is applied creating a new type of enlarged surface area described herein.

Textured shall be used interchangeably and synonymously with and to mean varied, corrugated, wrinkled, rippled, undulated, grooved, uneven, non-smooth and impregnated random peaked or pitted singularities.

Quarter sawn lumber shall mean any board or panel in which the grains are generally perpendicular to a major surface.

DESCRIPTION OF THE PRIOR ART

For all types of acoustical stringed instruments, strings are vibrated by strumming, plucking, striking and bowing in such a way as to directly or indirectly vibrate a connected resonant surface or sounding board (commonly referred to as the soundboard) to produce and disperse more audibly the desired musical sounds. Not so much a function of their supports, their frames, sides, lower backs or necks of the stringed instruments, the volume and quality of the sound is primarily a function of the characteristics and responsiveness of string-driven soundboards. Hence, the quality of sound generated by a stringed musical instrument can be enhanced by improving its soundboard. This is useful and desirable. As such, efforts to improve soundboard materials have evolved in modern times from using traditional organic materials (tone woods) to using laminated organic, mixed organic-inorganic materials and recently to synthetic composites of plastic or fibrous glass or graphite bonded by heat, pressure treatment or glued using resins and polymers in an attempt to improve sound production. In parallel and to further improve soundboards, special processes, additive structures, bracing and supports of soundboards have been developed and published. Special coating of stringed instrument soundboards has also been disclosed.

The soundboards of the majority of stringed musical instruments already in existence and of those currently produced are made of smooth-surface wood. With regard to natural wood soundboards, luthiers and piano makers have reported that certain spruce woods make superior soundboards for strings to excite and vibrate. Sitka spruce (*Picea sitchensis*) from the American Northwest coastline northward to Alaska is considered by many to be the wood most suitable for the soundboards of certain stringed instruments because of the combined elasticity and density characteristics provided by the uniform width of earlywood and latewood growth rings. The darker latewood growth rings in the wood are stiffer and more elastic in cellular structures than the softer earlywood growth. According to those trained in the art, when latewood growth rings are much wider than the earlywood growth rings, the existence of an excessive number of latewood grains, per unit area make the soundboards too stiff and dense to generate a warm and rich tone. On the other hand, when the earlywood growth rings are much wider than the latewood growth rings, the softness and porosity of the wood results in a muted tone that is not optimal for acoustical usage. Soundboards are typically fabricated from wood that is quarter-sawn so that growth rings appear as a series of straight alternating earlywood and latewood growth lines or grains. Soundboards are made so that the grains of the wood run uniformly in one direction throughout the entire soundboard, with the grains aligned parallel to the longest dimension of the soundboard, and either parallel or on a shallow angle with respect to the placement of the strings and/or the neck of the instrument. As no single piece of quarter-sawn lumber is sufficiently large for an entire soundboard, multiple strips are glued together at joints that parallel the grains. No cross-grain joints in the soundboard are permitted, as the glue and imperfect alignment of the grains would hamper the transmission of sound through the board. Not only does the longitudinal alignment of the grain abet the generation and amplification of sound, it also supports the tension and bending loads imposed by the tightened strings, which are attached directly or indirectly to the soundboard.

FIG. 1 is a simplified partial longitudinal cross section of a typical evenly finished and smooth-surface soundboard 100 made of natural wood, that would be embodied in a conventional stringed musical instrument. As is typical of soundboard woods, the earlywood growth rings or grain lines 101 alternate with latewood growth rings 102 to form a pattern of grain lines typically present in natural tone woods. Typically, most soundboards are assembled from slats or panels of wood in which the grain is running lengthwise, and which have been quarter-sawn so that the grain rings are oriented perpendicular or nearly perpendicular to the major surfaces of the slat or panel. The wood, or lumber, from which the slats or panels are made is selected from a species of tree having a desired stiffness-to-mass ratio, and which exhibits both a desired number of annual growth rings per unit of measurement and a desired average thickness ratio of earlywood growth rings to latewood growth rings;

Referring now to FIG. 2, the end of a log 200 is shown. Quarter sawn lumber, such as that in the upper left quadrant of the log 200, is produced by sawing a log through the center along a diameter plane, of which only a linear edge 201 of the diameter plane is visible in this figure). Each half of the log 200 is then quartered by sawing it through a radius plane, of which only a linear edge 202 is visible in this figure. By slicing the log along planes parallel to the central radius plane, of which only a linear edge 203 is visible in this figure, quarter-sawn boards or slats are produced. The prime boards 204 and 205 are those which are adjacent the central radius plane 203. These are the boards which have the grain most nearly perpendicular to their major surfaces. Such boards are inherently the most stable, and will warp very little, if at all, when moisture content changes from the value at the time the board was sawn. It will be noted that the grain on boards more distant from the central radius plane, such as board 206, have their grain more tilted from the major surface perrpendicular. Such boards, because they are quarter sawn, are only slightly less stable than the boards adjacent the central radius plane 203. The lower half of the log 200 has been plain sawn. Only the board 207 near the diameter plane 201 line has its grain generally perpendicular to the board's major surfaces. Only near the core of the log, where the grain rings are of much smaller diameter, does this characteristic not hold true. Boards near the edge of the log 200, such as board 208, have their grain running nearly parallel to the major surfaces. Such lumber is totally unsuited for soundboard fabrication, as it is inherently dimensionally unstable and will easily warp if the moisture content of the board changes from that which was present when the board was sawn.

Referring once again to FIG. 1, at least the visible exposed surface 103 of the soundboard 100 is typically highly polished to make it visually appealing. The smooth inner or unexposed surface 104 may or may not be varnished and polished. An instrument of the viol family has a soundbox with both inner (mostly hidden) and outer (visible) surfaces. The exposed surface 103 of soundboard 100 could be the outer exposed surface of the soundbox, while the unexposed surface 104 could be the inner surface thereof. In practice, wood stains and varnishes are applied to soundboard surface 103 for acoustic and esthetic reasons, as well as to preserve the wood.

Typically, energy from the excited strings of a musical instrument resonates through a soundboard made of natural wood or non-wood materials. The soundboard transfers the wave energy through the instrument and converts the energy into airborne sounds (pressure waves), which resonate from vibrating surfaces of the sounding structures of the stringed instrument. It is generally held that the velocity at which sound travels through a medium (e.g. the instrument and soundboard materials) is proportional to the square root of the ratio of elastic modulus (or stiffness) divided by the inertial modulus (or density-mass per unit area). By virtue of their demonstrated modulus ratios, spruce woods are viewed by purists as the natural material best suited for obtaining optimal velocity of wave energy propagation, which produces the most preferred sound quality from stringed instruments.

Soundboards manufactured from select spruce woods are tuned by carving and tooling them in a variety of ways so that they "play well." Each family of stringed instrument has a different soundboard fabrication process. A luthier for example, after performing traditional carving, shaping, thinning and smoothing procedures, would hold up and suspend the soundboard component at certain node points by holding the component between the fingers and, then, in a tapping or knocking fashion would use a knuckle of the other hand to drum a resonance tone from the wood in key areas on the soundboard, resulting in recognized and desired tones emanating from the wood. In addition, optimum soundboard thicknesses can be obtained during the carving process by periodically holding the soundboard up to a strong source of light, and noting the translucency in the various regions of the board.

Using modern technology, soundboards can now be acoustically tailored using electronic tone generators and variable amplifiers to drive electromagnetic speakers at defined frequencies and decibels to sympathetically vibrate stringed instrument components-especially soundboards. A soundboard, having its upper surface sprinkled with sawdust or colored glitter, is suspended over a driven speaker. Sound wave patterns generated in the sprinkled sawdust or glitter may be observed directly. The lightweight sawdust or glitter bounces and travels to areas on the surface of the soundboard where there are standing, or stationary, nodes of the sound waves. Using repeated incremental shaping and carving, testing, and observation of the sawdust or glitter pattern after each test, optimal thickness of the soundboard can be more accurately achieved. From a study of the prior art, it is believed that an optimal pattern derived from vibration testing would produce the most tailored sound from the soundboard.

Luthiers and piano makers over the centuries have learned that instrument functionality and beauty are a differential trade off, and often in conflict. To emit sound properly, stringed instruments must be as light and stiff as possible as the denser or inelastic the member the greater the degradation of sound as the soundboard takes too much energy to produce the acoustic values sought. If the string-driven timpanic structure is too thin or flimsy, the structure is not sufficiently rigid to withstand string tension causing eventual structural failure. Also under vigorous string excitation, over-drive distortion is produced. Ribs, thickening or topical bracing must then be added. The prior art is voluminous with such additive structural techniques. Laminated wood soundboards and non-wood materials have been developed to improve soundboard functionality. The prior art is also replete with these approaches. Artisans have also tried to increase the elasticity of soundboards by means of applying various solutions of finishes and varnishes that attempted to deliver beauty and greater functionality. But, all these methods failed because the coatings eventually lost their elasticity coefficient and bonding strength after a shorter or longer period of time causing an opposite undesirable effect due to their added distortional weight.

Several German luthiers of the Gropp family have adopted a guitar construction technique first developed by a famous German luthier named Richard Jacob Weissgerber who lived during the first half of the 1900s. Their advertised beauty mark on the top of a guitar surface is called a "grooved soundboard" not to be confused with the present invention. Like inlayed purfling around and along the outside edges of the top of a soundboard in the viol family of stringed musical instruments, a single groove is left in the wood surface of the top of an arch-topped Gropp guitar. The groove runs around the outside perimeter of the whole top, excepting under the fingerboard. This groove gives unique character and beauty to low and mid-priced hand-made Gropp guitars. In contrast, the present invention uses a plurality of pronounced grooves and corrugations in the overall surface of a soundboard, parallel to the grain structure, to create improved sound production.

The present invention adds new art to the present field. The present invention is unique with respect to the prior art. Only indirectly related prior art from the field of acoustics has been discovered. Corrugated and grooved surfaces have heretofore been used in two products: sound attenuating panels and sound diffuser panels. For the sound attenuating panels, the corrugated and grooved surfaces provided both structural support to the panel and reflection of incoming sound waves into a sound-deadening core material. For the sound diffuser panels, the corrugated and grooved surfaces the corrugated and grooved surfaces assist in the reflection of sound from an incoming remote source.

U.S. Pat. No. 5,856,640 to Lynn discloses a porous element, pillow or acoustic cushion for the reduction or elimination of noise in buildings, from highways, from industrial machinery, and from airports comprising a sound transparent covering and a sound absorbent interior with the element or pillow being used singly or in properly spaced arrays supported and attached on a corrugated surface to structurally support and to help reflect unabsorbed sounds back into the rearward parts of the acoustic cushions attached.

U.S. Pat. No. 5,153,048 to Fry, et al. U.S. Pat. No. 5,153,048 discloses a fabric covered board structure made with a base of a mineral fiber material having first a corrugated face surface. Then a discontinuous coating of high tack adhesive is applied on the corrugated face surface and a flexible textile or vinyl sheet is adhered to the face surface by the adhesive making an acoustical wallboard for sound absorption.

U.S. Pat. No. 4,244,439 to Wested discloses a sound-absorbing structure comprising a plurality of linear and parallel grooves in the surface of the sound attenuating structure and ribs between the grooves. The structure is employed to dampen sound, which is delimited by a substantially plane surface, e.g. a ground surface, a sound field propagating essentially in parallel with said surface. The object of the art is to dampen sound fields that originate from traffic on a motorway or an airport. The grooves of the structure are arranged in such manner, that a sound attenuation is obtained, in terms of the direction of propagation of the sound field, behind the structure by means of an acoustic coupling between adjoining grooves at the sound frequencies to be damped. The sound suppressing surface of the sound-absorbing structure is situated substantially in the surface. A cross-section of the structure has an outline similar to a square wave or a sine curve. The structure may include two or more groove systems each having the grooves spaced differently or each having varying groove-depths or both measures in combination, thus making it possible to damp a broader sound frequency range.

Unlike the present invention, the '640 and '048 and '439 patents use grounded and stationary materials having corrugated or grooved surfaces to directly or indirectly attenuate or absorb sound waves projected toward them. The function of both of these products is the antithesis of the object of the present invention, which is that of providing enhanced resonance from a primary source—namely a string-driven, vibrating soundboard provided with an uneven, varied and overall textured surface.

The following identified patents illustrate the use of corrugated and grooved surfaces in sound diffuser products. U.S. Pat. No. 4,821,839 to D'Antonio, et al. discloses a sound absorbing diffusor device having a surface that includes a plurality of sound absorbing wells of equal widths but different depths separated by thin sound absorbing dividers. The depths of the individual wells are based upon the quadratic-residue number theory sequence used in acoustic design. The device offers significant reduction in reflected sound levels, as compared with a flat absorptive panel. U.S. Pat. No. 5,401,921, also to D'Antonio, et al. discloses a two-dimensional primitive root diffusor having a two-dimensional pattern of wells, the depths of which are determined through operation of primitive root sequence theory. This device is designed to provide uniform scattering of sound waves in lateral direction, while suppressing mirror-like specular reflections, thereby increasing the indirect sound field to a listener. U.S. Pat. No. 5,969,301 to Cullum, Jr., et al. discloses an acoustic diffuser panel that claims to be an improvement on that of the '921 patent to D'Antonio, et al. in that is more manufacturable. This panel features a sound reflective surface having a plurality of generally parabolic shaped wells interconnected by junctions and bounded by an outer lip. The sound reflective surface of the panel is generally curvilinear. The total number of sound wells of the panel is equal to a modulus that is the lowest prime number exceeding the quotient of the highest frequency of the range of frequencies to be diffused divided by the lowest frequency of the range of frequencies to be diffused. The wells at their opening each have particular width less than or equal to the quotient of the speed of sound divided by the product of two times the lowest frequency of the range of frequencies diffused. Each well has a depth equal to a value of a quadratic residue number theory sequence, $n^2$ (modulus N), multiplied by a constant equal to the frequency wavelength of the lowest frequency divided by the product of two times the modulus, wherein n is equal to each integer from 0 to N−1. The acoustic diffuser panel is manufacturable as a single integral unit by molding.

Unlike the present invention, the '301, '839 and '921 patents advance the art for passive sound diffusors, which reflect, diffuse, and in the case of at least the '839 patent, partially attenuate sounds from a separate generating source. The objects of the present invention, on the other hand are, firstly, to actively generate and launch more sound waves from an energized textured vibrating soundboard of a stinged musical instrument and, secondly, to reflect and rediffuse the sound waves which have been generated and launched.

Since its arrival in the marketplace, flexible wall corrugated plastic pipe has been useful in a variety of well-known automotive, construction, industrial and medical applications. It was discovered, almost simultaneously throughout the world, that corrugated pipe, when swung through the air in a circular plane, generated a musical tones. The musical tones apparently result from air being sucked into the tube at the relatively immobile end (i.e., the end being held) and passing over the inner corrugated surface, thereby setting up a standing wave which, at certain frequencies, plays the natural harmonic overtone series of the tube, the same overtone series that characterize the bugle. U.S. Pat. No. 4,116,108 to Hyman discloses an improved corrugated musical tube that may incorporate a vibrating reed for varying the range of generated tones.

As a further development of the corrugated musical tube, U.S. Pat. No. 6,042,447 to Thompson, discloses hand-operated animal call that includes a vibrating reed sound generator positioned to vibrate within a hollow reed housing. The reed housing is positioned within an air impervious pouch, which has a restricted opening. An elongate sound modifying tube constructed of flexible wall corrugated plastic pipe is attached to the reed housing and protrudes through the restricted opening in the pouch. The pouch is filled with a porous, compressible fiber with an elastic memory. When the pouch is manually squeezed, air is forced through the reed housing, thus vibrating the reed, which, in turn, causes the reed housing and elongated sound modifying corrugated plastic tube to vibrate as well to simulate a deer or buck mating call. The corrugated plastic tube of the '447 patent acts as a suitable flexible trachea-like conveyor of sounds generated by the vibrating reed sound generator.

U.S. Pat. No. 4,362,079 to Kelly proposes adding additional mass to a soundboard, in the form of an additive domed Sitka spruce plate, as a means for improving soundboard performance in stringed musical instruments. Naming the new art an accentuator plate, the device is mounted in a cutout opening provided for that purpose in the top surface of the hollow body of a vibrating soundboard type of stringed musical instrument. The accentuator plate has an outward, generally convex contour, and it has an inside generally concave contour to provide the accentuator plate with a thin, dome-shaped geometry. The accentuator plate is located adjacent to the lowest note string and substantially behind the bridge on the soundboard of the stringed musical instrument. For best results, ignoring possible conflict with requisite soundboard underbracing, this patent disclosure prescribes that the kidney-shaped accentuator plate comprises at least five percent and not more than thirty percent of the total surface area of the top surface of the instrument's body.

Unlike the device of the '079 patent, the present invention can be applied without limitation to all planar or curved soundboard surfaces without any impact to other structures. Further distinguished from the present invention, the device of the '079 patent requires complete removal of some soundboard material and an addition of bulged replacement material in the soundboard, thereby increasing both the mass and surface area of the soundboard. The invasive installation procedure required by the '079 device poses a great risk of damage to the unmodified soundboard, and greatly increases the complexity of the instrument. Removal of underlying soundboard bracing may be required to complete a retrofit installation, and its use on the soundboard of a piano may interfere with nearby action components.

SUMMARY OF THE INVENTION

From the foregoing description of the prior art, together with their differences, drawbacks and disadvantages, it will be seen that simple and efficient means are herein provided for accomplishing the scope and object of the present invention. The present invention relates to a new method and process that improves soundboards and resulting sounds from stringed instruments by means of establishing a new textured surface on soundboards, which method is distinguished and independent of all the above identified prior art as described.

Stringed instrument sound quality is paramount. A general object of the present invention is to provide a vibrating soundboard of a stringed musical instrument with improved sound qualities including increased volume, timbre, projection, tonality and sustain of acoustical output. The advantage obtained is a more valuable instrument to both manufacturer and ultimate owner based on these esthetic valuation criteria.

Another object of the present invention is to increase the string-driven vibrating surface area on the surface of a soundboard. The advantage obtained by increased surface area is a greater acoustical potential energy output over a larger surface area enabling greater diffusion of generated and reflected sound waves from the vibrating surface. Another advantage obtained is reducing standing waves and thwarting disharmonics.

A further object of the present invention is universal application of the method to flat or curved soundboard surfaces on all types of stringed musical instruments. The advantage obtained is the structural integrity of incumbent braces and supports of soundboards can be maintained as the soundboard surfaces can be improved between and around such structural members. For that matter, surfaces on the braces and supports themselves can receive the method and process of the present invention, as they are also connected fixtures to vibrating soundboards. Another advantage obtained is non-degradation of the improvement to soundboards. The improvement to the soundboard will last as long as the materials that comprise the soundboard itself.

Yet another objective of the present invention is a simple application of the method and process to soundboards during new construction and retrofit service maintenance of stringed musical instruments. The advantage obtained here to OEM and aftermarket applications is that all types of stringed instruments may be universally fitted with the present invention. Another advantage obtained from the present invention is that it is well suited to automated manufacture of and application to soundboards.

These objects are met by pronounced textured, wrinkled, undulated parallel and non-parallel corrugations or non-smooth impregnated singularities of varied shape being of uniform or non-uniform depths and widths applied as a plurality to all or part of the overall surface of the stringed instrument soundboard with out increasing the total mass of the soundboard.

Other sound generating panels are contemplated by this invention. Loudspeakers benefit from diaphragms and speaker cones fabricated from material having at least one textured surface, in that the textured surfaces increase the volume.

DETAILED DESCRIPTION OF THE PREFERRED EMBODIMENT

This invention includes textured surfaces for sound transmitting panels, as well as methods for making such surfaces. For a first general embodiment of the invention, textured surfaces are provided on at least one major sounding surface of a wood soundboard that is to be acoustically driven by the strings of a stringed musical instrument. The textured soundboard surfaces are preferably created by compressing the surface material of earlywood growth rings, or grains, to form a series of generally parallel grooves, each of which lies between a pair of latewood growth grains. Each groove is created with a scribing operation using either a stylus or rotating wheel tool, similar to a pizza cutter, of an appropriate size and shape. This is considered the preferred embodiment for wood soundboards because compression of only the surface material of earlywood growth grains does not adversely affect the structural integrity of the panel. In fact, the partial compression of earlywood growth grains not only increases the surface area of the panel, but increases its stiffness (i.e., modulus of elasticity) as well. Alternatively, a pattern can be stamped or rolled into the surface without regard for the position of earlywood and latewood grains. Though not a preferred method of increasing the surface area of a wood sound transmitting panel, it would be far less labor intensive to press or roll a pattern onto a wood surface without regard to the position of the different grain regions.

Figure 1:
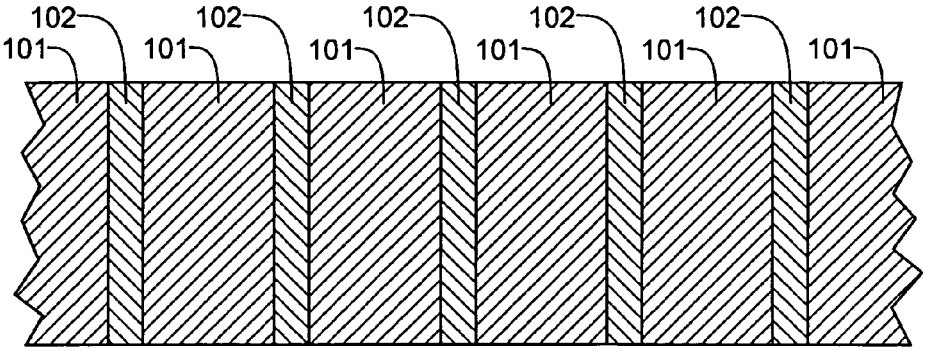
FIG. 1 (PRIOR ART)
FIG. 1 is a simplified cross section of an untreated natural wood soundboard.
Figure 3:
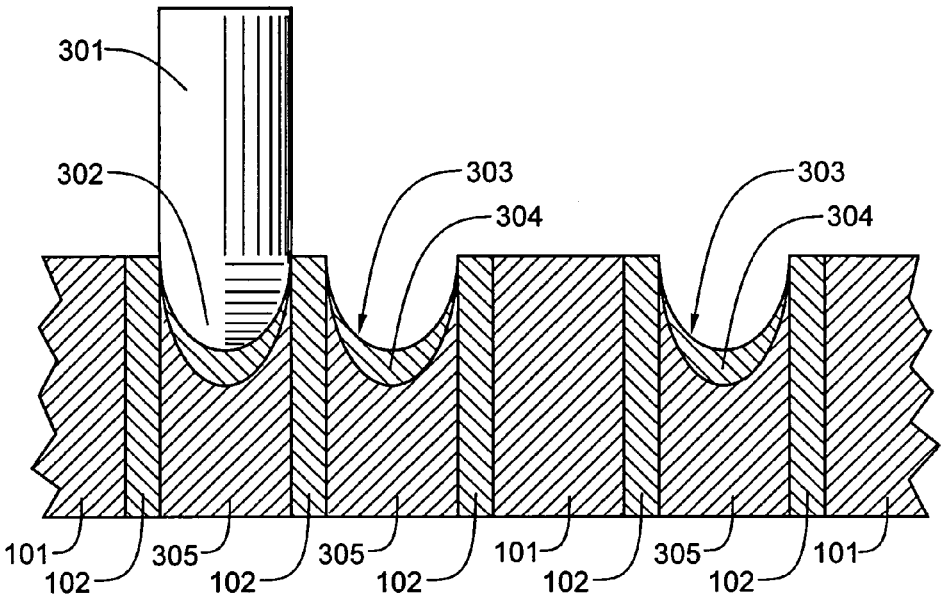
FIG. 3 is a simplified cross section of a natural wood soundboard after several of the early growth grains, on a single major surface thereof, have been grooved to a generally uniform depth using a stylus having a paraboloid tip.

Referring now to the wood panel 300 of FIG. 3, the upper surface of wood panel 100 of FIG. 1 has been partially treated with a stylus 301 having a paraboloid-shaped tip 302. More specifically, the tip 302 has the shape of a parabola that has been rotated 180 degrees about its axis of symmetry. The paraboloid tip 302 is preferably of a gauge that is wide enough to span the entire width of each earlywood grain 101, as positioned between an adjacent pair of latewood grains 102. The gauge of the tip can be selected for each earlywood grain width. Applying downward pressure that is preferably constant for each earlywood grain 101, the stylus 301 is drawn longitudinally on top of each earlywood grain 101, thereby compressing surface material of the earlywood grain 101, and leaving a mechanically depressed groove 303 having the inverse cross-sectional profile as that of the tip 302. The compressed earlywood material 304 at the bottom of the groove 303 assumes a modulus similar to those of the tangential latewood 102. Thus, the compressed earlywood material 304 becomes a bridge of "virtual" latewood over the underlying uncompressed earlywood material 305 and between adjacent pairs of latewood grains 102. Empirical evidence shows that this additional vibrational axis—a quasi-horizontally polarized modulus of stiffened earlywood—apparently helps to separate possible overtones and sound cancellations, thereby generating improved intonations across the spectrum of sounds produced by the soundboard. Grooves 303 of constant or varying depth may be created by varying the downward pressure on the stylus 301 or by repeating the grooving step multiple times for each earlywood grain 101.

Figure 4:
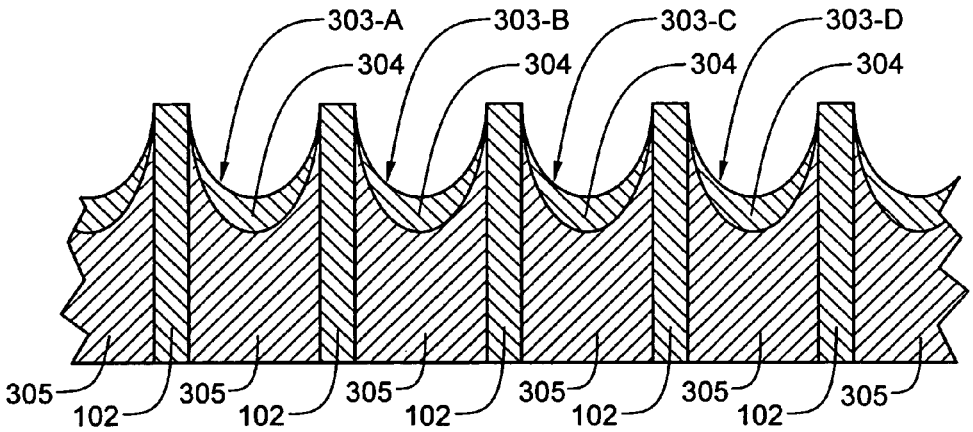
FIG. 4 is a simplified cross section of a natural wood soundboard after all early growth grains, on a single major surface thereof, have been grooved to a generally uniform depth using a stylus having a paraboloid tip.

Referring now to FIG. 4, the upper surface of wood panel 300 of FIG. 3 has been fully treated so that all grooves 303 have a parabolic cross section and are of generally uniform depth. Individually, the grooves are designated by the general item number 303, followed by a specific letter identifier. Thus, the four grooves of which a complete cross section is shown are labeled 303-A, 303-B, 303-C and 303-D. This same numbering scheme will be followed for subsequent similar drawing figures. As a result of the grooving process, the resulting soundboard 400 has been endowed with different resonance properties. The wood panel of the soundboard 400 is now stiffer, having a larger modulus of elasticity, although its mass remains unchanged. In addition, the surface area of the soundboard 400 has been more than doubled by the grooving process. This increase in surface area translates into greatly enhanced resonance.

Figure 5:
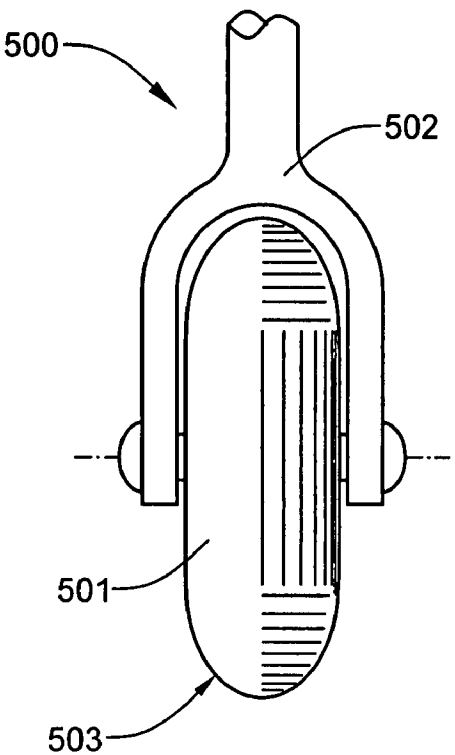
FIG. 5 is a front elevational view of a groove-making rotating disk tool, the disk of which has an edge with a parabolic profile.
Figure 2:
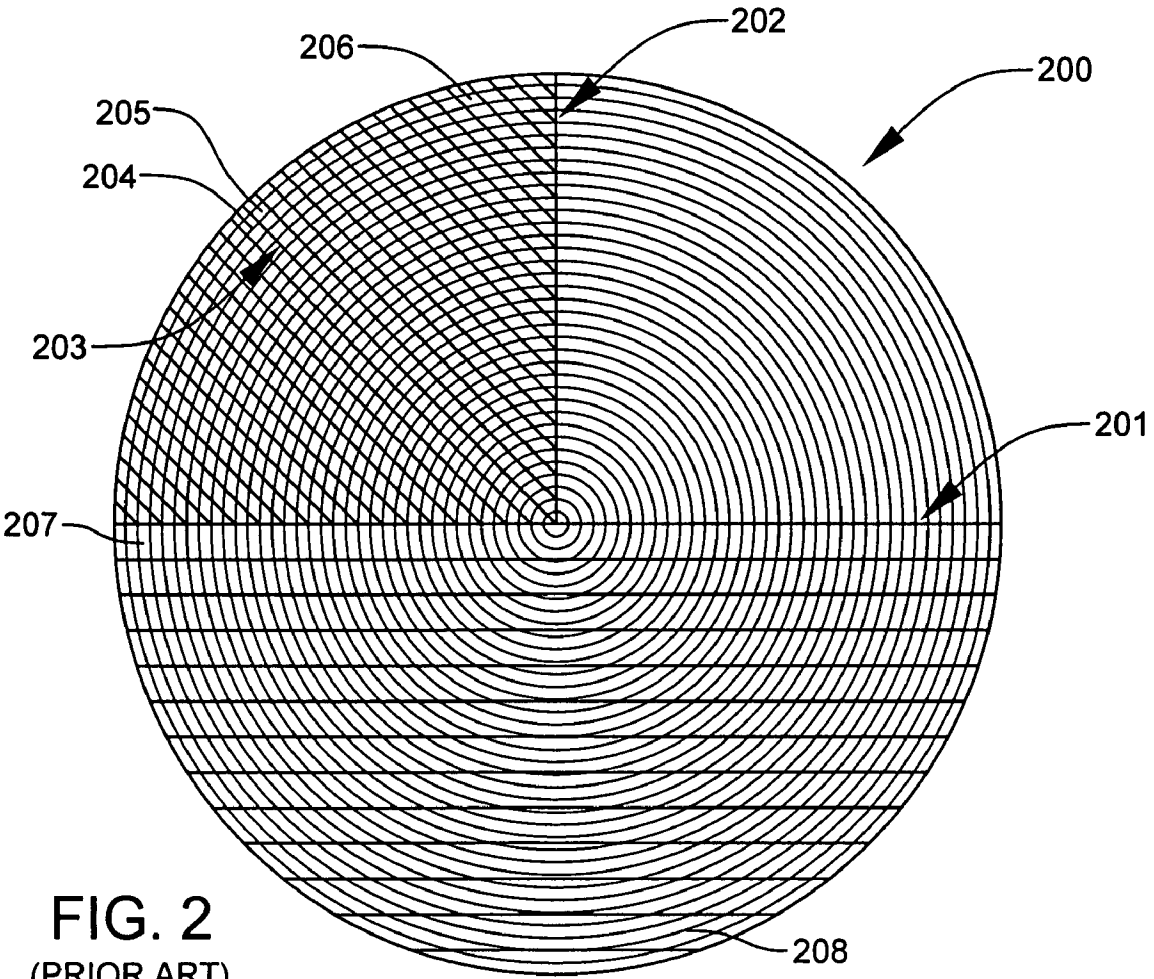
FIG. 2 (PRIOR ART)
FIG. 2 is an elevational end view of a log that has been quarter sawn in the upper left quadrant and plain sawn in the lower two quadrants.

Referring now to FIG. 5, a rotating disk tool 500 is shown which may be used in place of a stylus 301 having a paraboloid tip 302. The rotating disk tool 500 has a disk 501 that is rotatably mounted within a frame/handle 502. It will be noted that the rotating disk 501 is radially symmetrical, and has a circumferential edge 503 with a parabolic profile.

Figure 6:
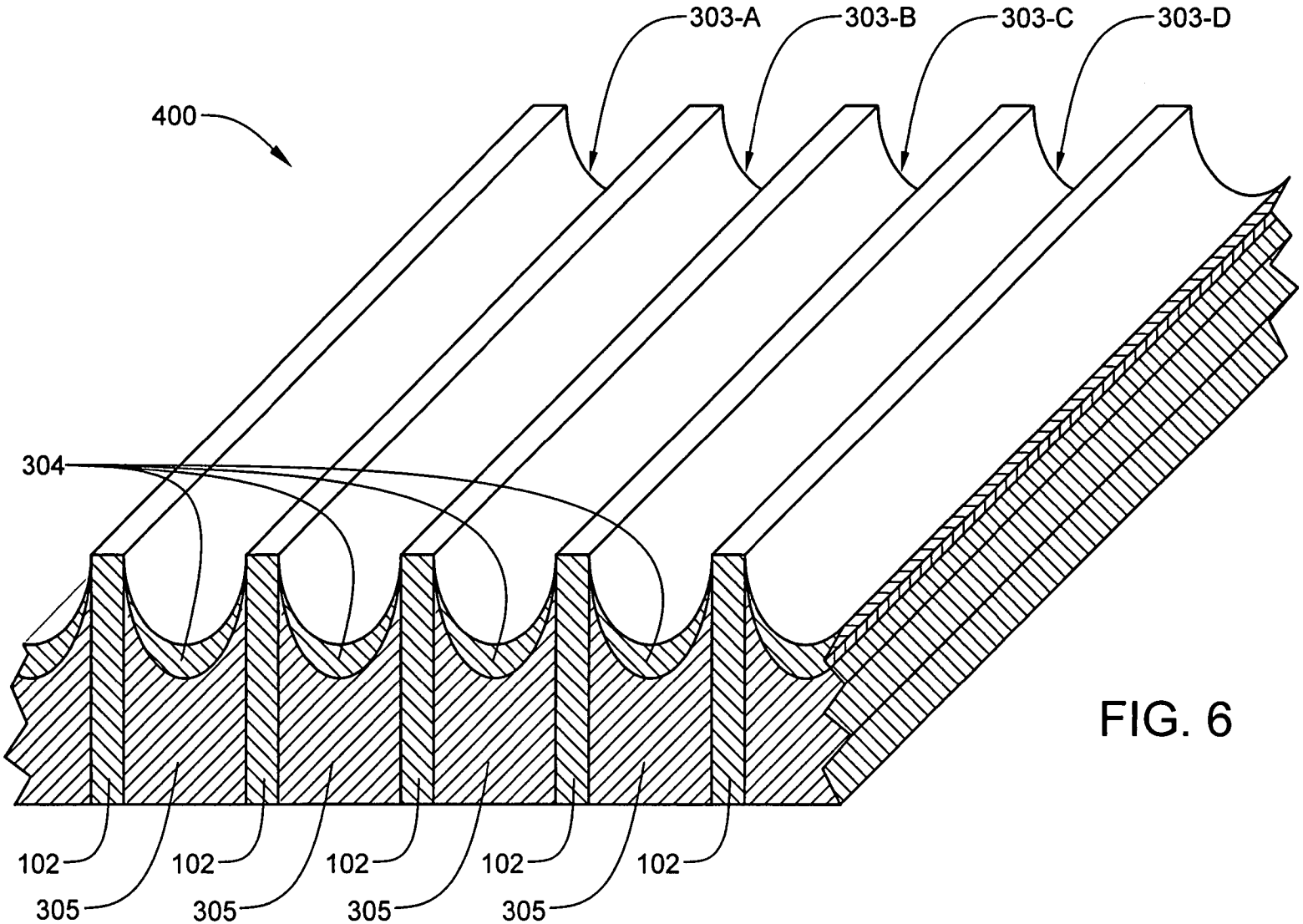
FIG. 6 is an isometric view of the natural wood soundboard of FIG. 3.

Referring now to FIG. 6, the soundboard 400 is shown in an isometric view. It can be clearly seen that each groove 303 extends the full length of its associated earlywood grain, between two latewood growth grains 102.

Figure 7:
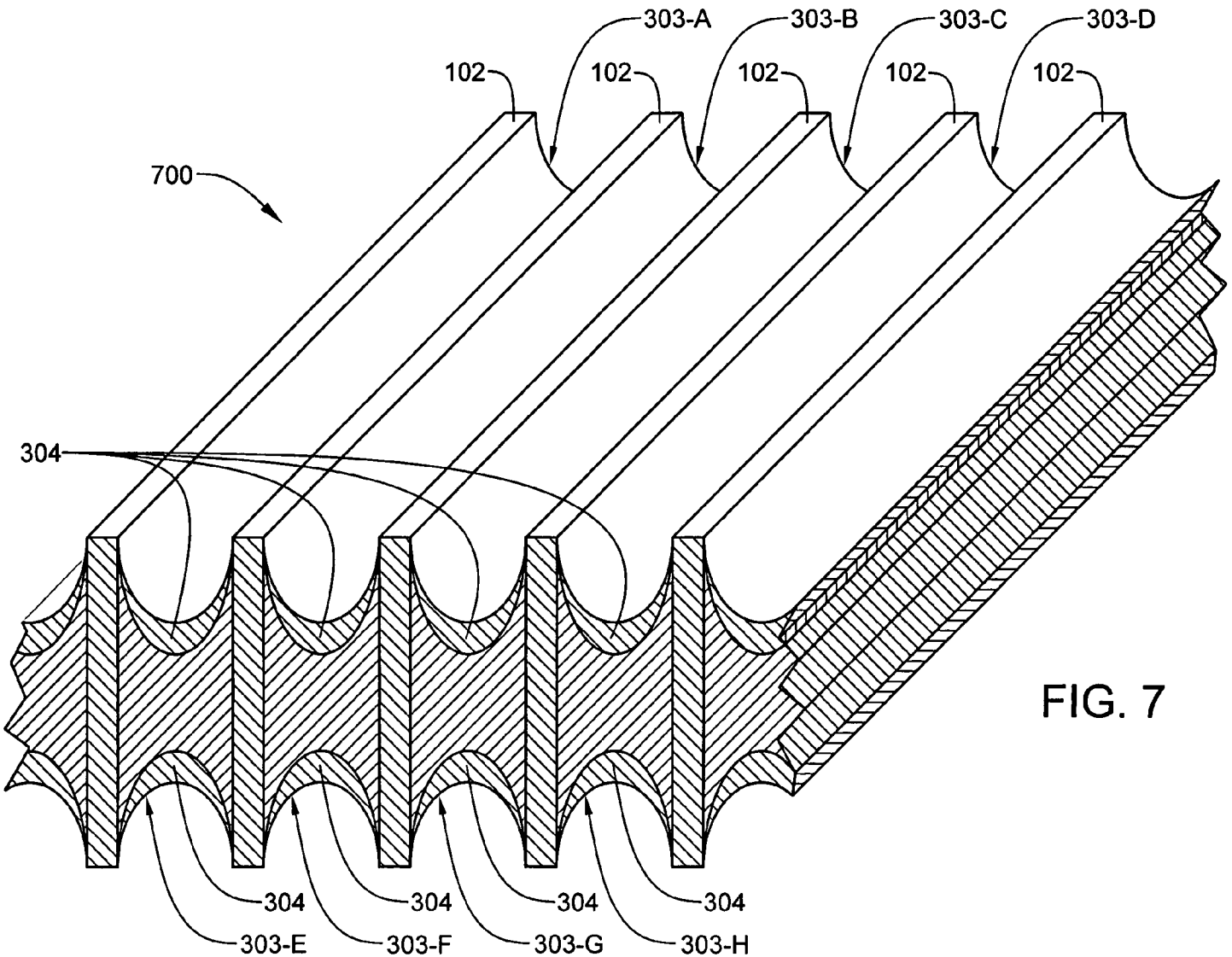
FIG. 7 is an isometric view of a natural wood soundboard having all early growth grains on both major surfaces thereof grooved to a generally uniform depth using a stylus having a paraboloid tip.

Referring now to FIG. 7, the soundboard 400 has been further treated by grooving its lower surface so that it is a mirror image of the upper surface. The benefits accruing to the resulting soundboard 700 are cumulative, with the total surface area being more that four times that of the surface area of the untreated (i.e., ungrooved) soundboard 300. Resonance and stiffness are, thus, also increased. By grooving both sides of the soundboard 700, optimum resonance results are obtained.

Figure 8:
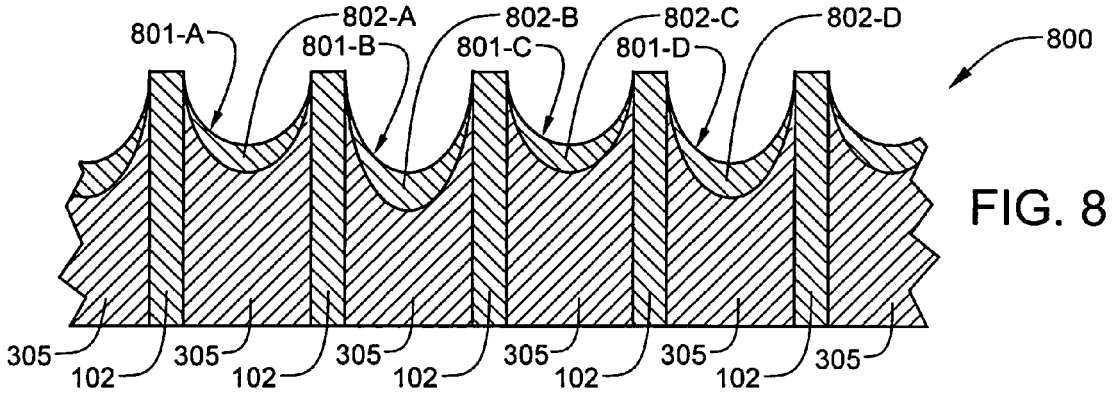
FIG. 8 is a simplified cross section of a natural wood soundboard after all early growth grains, on a single major surface thereof, have been grooved to varying depths using at least one stylus having a paraboloid tip.

Referring now to FIG. 8, each of the earlygrowth grains 101 on the upper surface of soundboard 100 have been grooved to varying depths using at least one stylus 301 having a paraboloid tip 302 or a rotating disk tool 500 having circumferential edge 502 with a parabolic profile. The resulting soundboard 800 may have improved responsiveness to different frequencies of sound waves. Four complete grooves of parabolic cross section are shown on the completed soundboard 800: 801-A, 801-B, 801-C and 801-D. The regions of compressed earlywood at the bottom of each such groove are 802-A, 802-B, 802-C and 802-D. As the depth of each of the grooves 803-A, 803-B, 803-C and 803-D is of a different depth, the degree of earlywood grain compression in regions 802-A, 802-B, 802-C and 802-D also varies.

Figure 9:
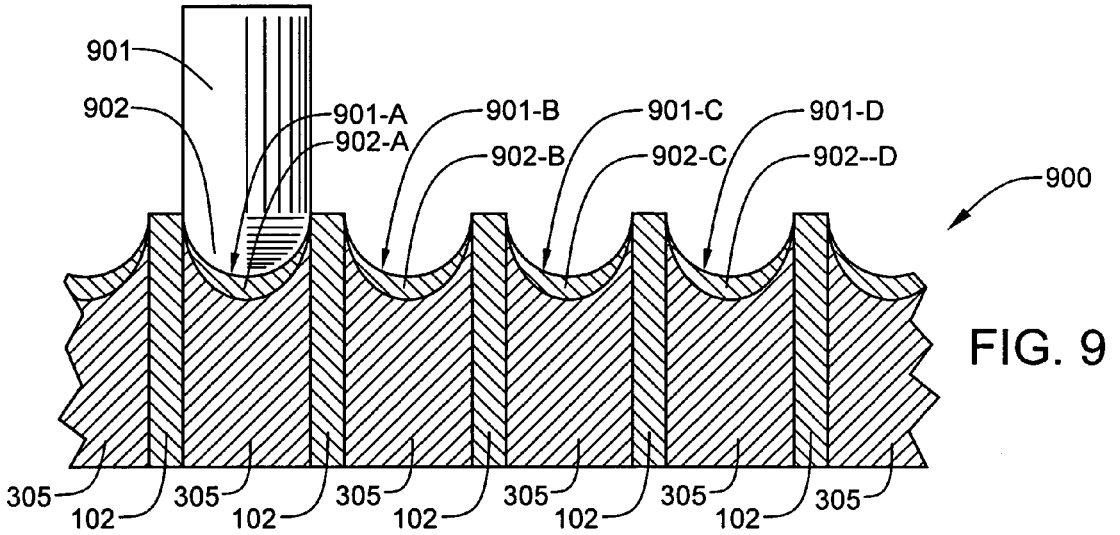
FIG. 9 is a simplified cross section of a natural wood soundboard after all early growth grains, on a single major surface thereof, have been grooved to a generally uniform depth using a stylus having a hemispherical tip.

Referring now to FIG. 9, each of the earlygrowth grains 101 on the upper surface of wood panel 100 has been grooved to a constant depth using either a stylus 801 having hemispherical tip 902 or a rotating disk tool similar to that of FIG. 4, but with a disk having circumferential edge of semicircular cross section (not shown). The resulting soundboard 900 has four grooves of semicirular cross section: 901-A, 901-B, 901-C and 901-D. The regions of compressed earlywood at the bottom of each such groove are 902-A, 902-B, 902-C and 902-D.

Figure 10:
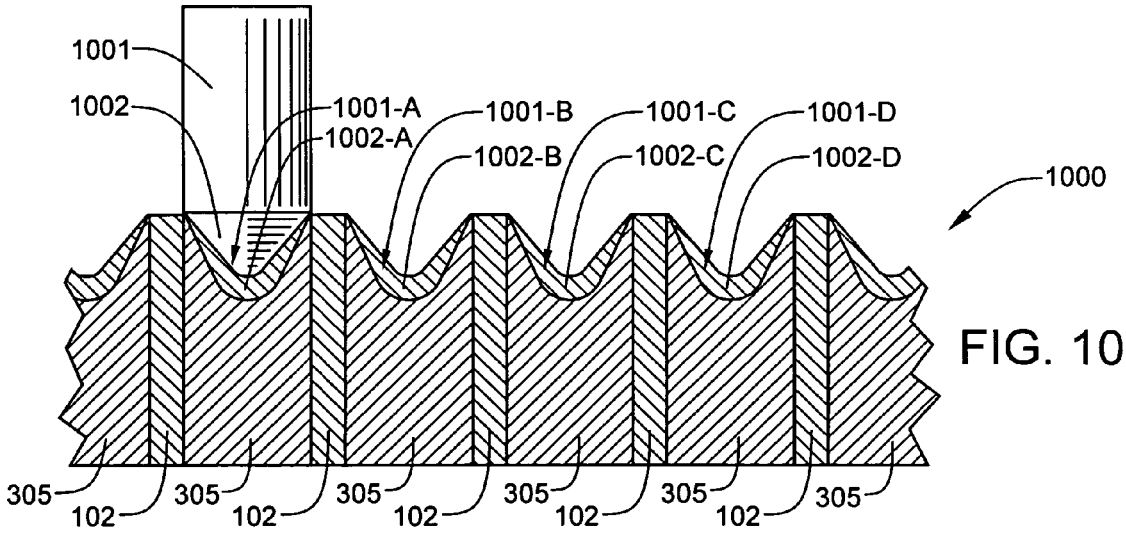
FIG. 10 is a simplified cross section of a natural wood soundboard after all early growth grains, on a single major surface thereof, have been grooved to a generally uniform depth using a stylus having a domed conical tip.

Referring now to FIG. 10, each of the earlygrowth grains 101 on the upper surface of wood panel 100 have been grooved to a constant depth using either a stylus 1001 having a doomed conical tip 1002 or a rotating disk tool similar to that of FIG. 4, but with a disk having circumferential edge of rounded-V-shaped cross section. The resulting soundboard 1000 has four grooves of rounded-V-shaped cross section: 1003-A, 1003-B, 1003-C and 1003-D. The regions of compressed earlywood at the bottom of each such groove are 1004-A, 1004-B, 1004-C and 1004-D.

Figure 11:
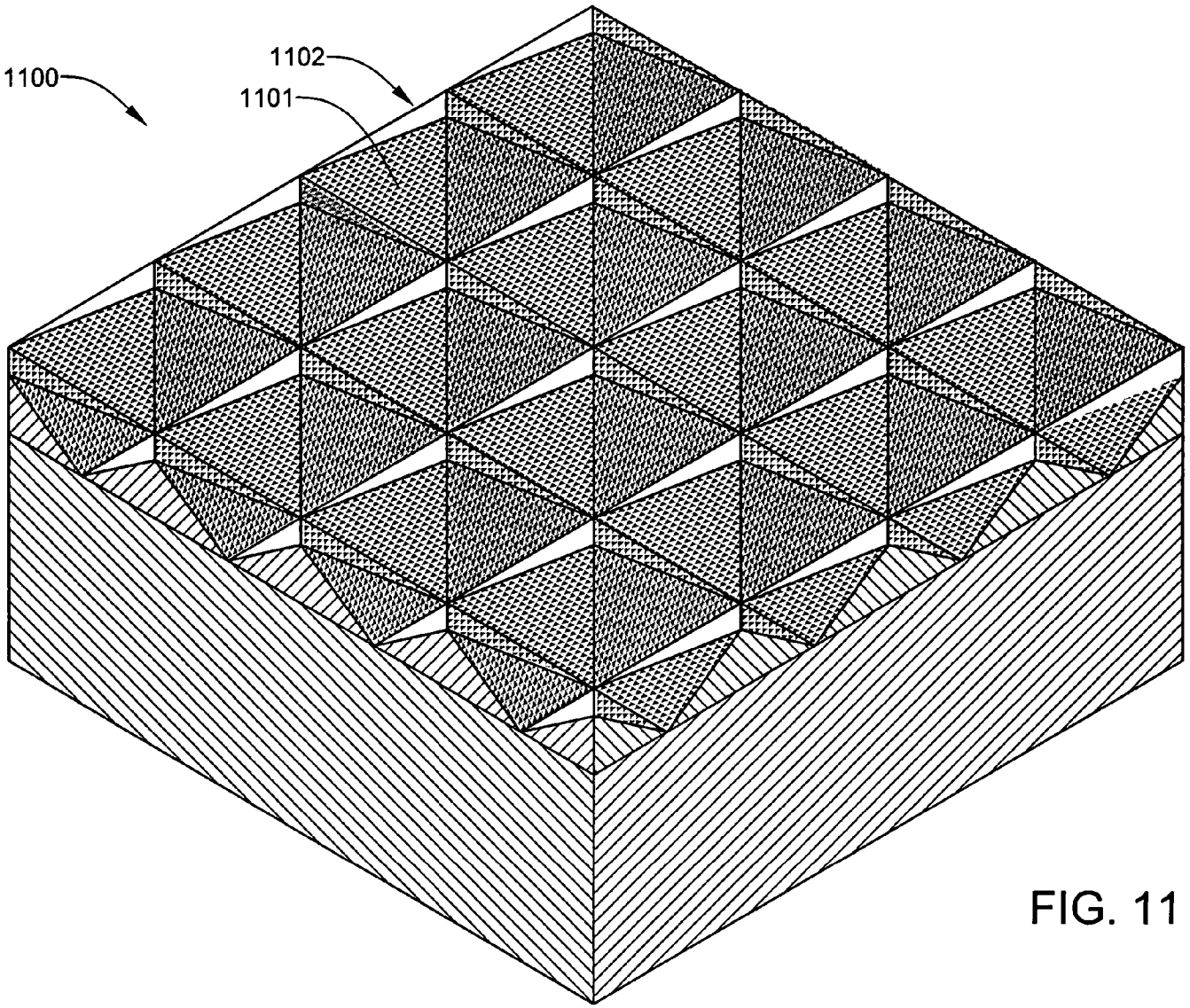
FIG. 11 is an isometric view of a natural wood soundboard having an upper surface that has been textured with an array of contiguous pyramids.

Besides circular and parabolic shaped valleys, other corrugation and texture types may be used to increase the soundboard surface area. Referring now to FIG. 11, a wood panel or laminar sheet of some other sound resonating material 1100, has been stamped with a repeating pyramidal textured surface pattern 1101 on its upper surface 1102 in order to increase its surface area. If acute angle θ of each pyramid is 45 degrees, the increase in surface area will be the original surface area multiplied by the square root of 2, or about 1.412. Of course, the greater the angle θ, the greater the increase in surface area. The pattern is stamped on the panel or sheet using either a stamp having the inverse pattern as the finished product, or a roller on which the inverse pattern has been applied. It is well known that soundboards for stringed musical instruments can be made of a number of resonant materials, including wood, sheet metal and even composite materials. By virtue of this geometry, wave energy fluidically traveling throughout the non-rectangular soundboard can assumedly escape easier through the textured surface pattern 1101 and excite a greater mass of air molecules in contact with said surface, resulting in a larger quantity of air pressure generated sound waves as observed during tests. The results are similar to why a timpani (kettledrum) can be much louder more dynamic than a bongo.

Another aspect of the present invention is the creation of so called waveguides and emitters from the peaks and valley of the pronounced textured surface. For example, the grooves of the textured soundboards of FIGS. 3, 6, 7, 8, 9 and 10 guide and spread the sound waves across the entire surface of the soundboard. It is assumed that as the sound waves are launched by vibration into the air, the peaks 406 (i.e., the exposed tops) of the latewood grains 102 of any of the aforementioned soundboards, cause to help emit, focus and launch air pressure waves more conically directed into the stringed instrument sounding chamber creating a more concentrated acoustic effect. As a result, greater sound amplification can be achieved and has been demonstrated during tests. It should also be noted that the peaks 406 of the latewood grains 102, whether they be flat (as shown), arched, rounded, or peaked, will function as sound emitters.

With the aim of increasing soundboard surface area as much as possible by texturing, the sizes of the textures and corrugations on the textured soundboard surface may have, as various uniform and non-uniform depths and widths depending upon the application of the invention on wood or non-wood materials used in vibrating soundboards and similar sound generating surfaces. The texturing widths may range from few parallel or non-parallel corrugations in the textured soundboard surface to thousands of parallel or non-parallel corrugations or impregnated regular or irregular singularities per unit of surface area. Depending upon the stiffness and mass density of the soundboard, the depth of the corrugations and impregnations on the textured soundboard surface may range from a depth nearly equal to the thickness of the soundboard to barely applied in the overall surface. For what are presently considered preferred embodiments of the invention, texture depth should generally range between 25% to 100% of the width of a single texture feature. Thus, for a grooved soundboard, the depth of each groove should preferably range between 25% to 100% of the width thereof. Texture widths will generally measure less than the thickness of the soundboard. This flexible aspect of the present invention enables the surface of any stringed instrument sounding surface various and graduated texturing implementations such as but not limited to deeper and broader corrugations or impregnations ranging to narrower and shallower corrugations, stamping or impressions variously mixed or separated into discrete regions on the same soundboard.

To create a textured soundboard, which achieves the desired results, the present invention may be carried out with or without respect to the earlywood or latewood grains of the wood because certain woods and non-wood materials do not have such growth rings or grains of dissimilar modulus properties to follow along with tooling to create a plurality of grooves as described in one embodiment of the invention. Creating pronounced grooves, corrugations and textures in such non-grained wood or non-wood materials used for soundboards is within the scope and object of the present invention. Furthermore, soundboards made of wood or non-wood materials could have applied textured patterns in more than one direction crossing each other from obtuse or acute angles, and leaving uniform or non-uniform flat or rounded diamond patterns, or flat or rounded waffle-faced surfaces. Furthermore, a plurality of welled or conical patterns may be produced in all or part of the soundboard surface by tooled stampings, impressions or molding processes.

Figure 12:
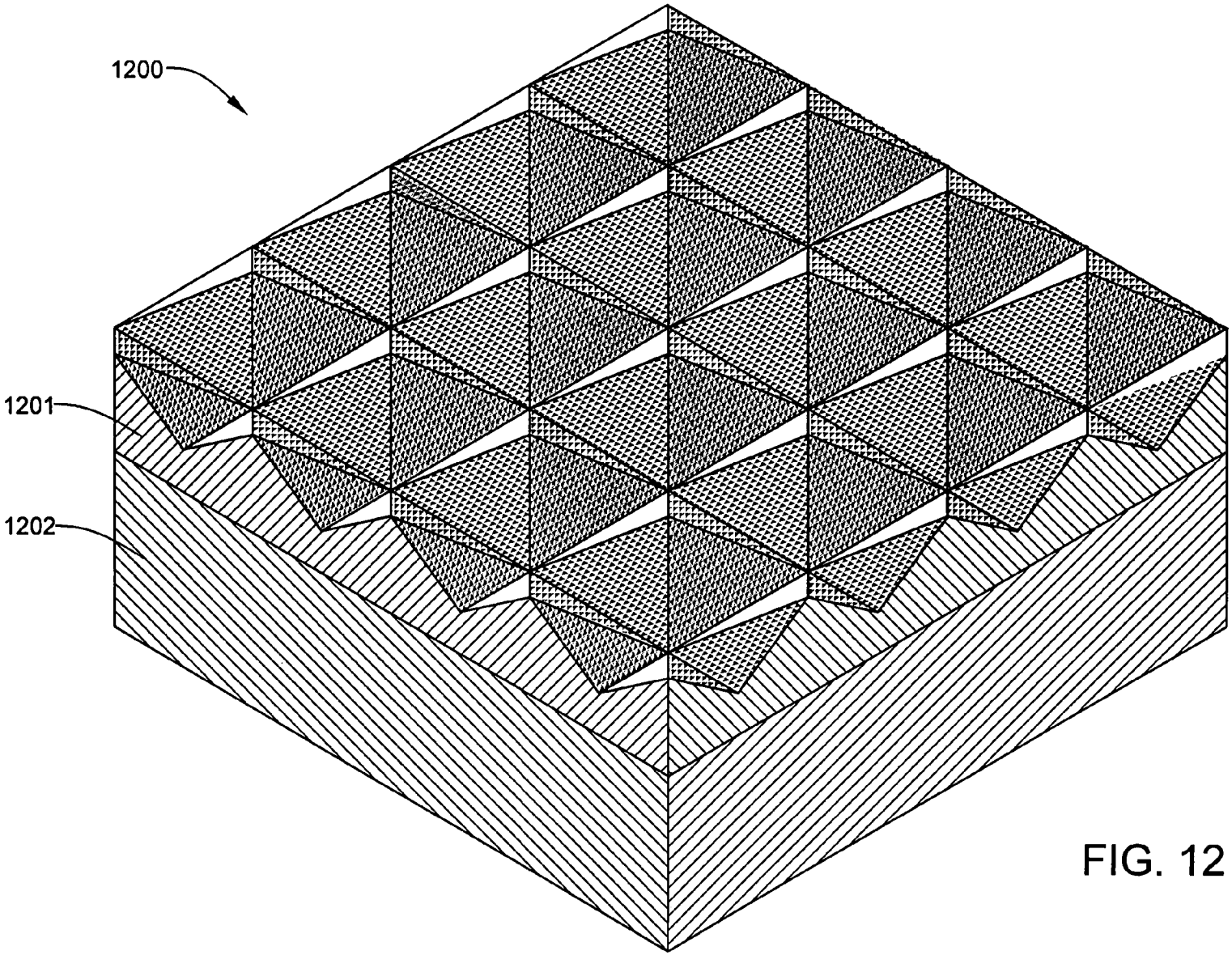
FIG. 12 is an isometric view of a composite soundboard having a pressed textured layer bonded to an underlying panel.

Referring now to FIG. 12, an alternative embodiment may be achieved by bonding a "skin" of pre-textured material 1201 to the surface of a laminar soundboard 1202 to create a composite soundboard 1200 and achieve similar results. This skinning method and process of affixing a second textured structure to a first soundboard surface to create a pronounced textured and corrugated soundboard surface is to be considered within the scope of the present invention. The textured material layer may be either flexible, semi-rigid, or rigid.

Certain automated processes may be employed to create corrugated and textured soundboard surfaces. For example, CNC micro-surface-routing of the earlywood grains using optically-guided mechanical or scanning laser etching equipment may be used. Using such machinery, an amount of earlywood grain may be removed from the surface of a wood soundboard sufficient to produce corrugation or texturization on the surface thereof. The same types of automated processes may be employed with respect to non-wood panels.

In addition, soundboards made of non-wood or composite materials can be pressed, extruded, molded, laid-up, tooled, cut and finished in such a way as to leave textures and corrugations of various widths and shapes in the surface of stringed instrument and their soundboards not unlike those described herein. Since the materials used in this extension of the present invention are non-wood, the corrugation pattern may be applied in more than one direction crossing each other from obtuse to acute angles leaving flat or rounded diamond patterns or flat or rounded waffle faced surfaces including wells and cones.

Sand, bead or sublimable particle blasting may be used to selectively remove softer earlywood leaving a corrugated surface with the harder latewood remaining exposed in peaks not unlike the individually worked earlywood grains compressed by the stylus described herein. This sand blasting process may also be used on masked non-wood materials leaving a desired surviving texture in the soundboard.

Another possible option is to use a process similar to a shot-peening process which would compact the softer earlygrowth grains more than the more dense lategrowth grains, without removing significant amounts of earlygrowth material, in order to create a soundboard that is structurally similar to those shown in FIGS. 3, 6, 7, 8, 9 and 10. That is, a soundboard so created would have both greater surface area and a greater modulus of elasticity.

Figure 13:
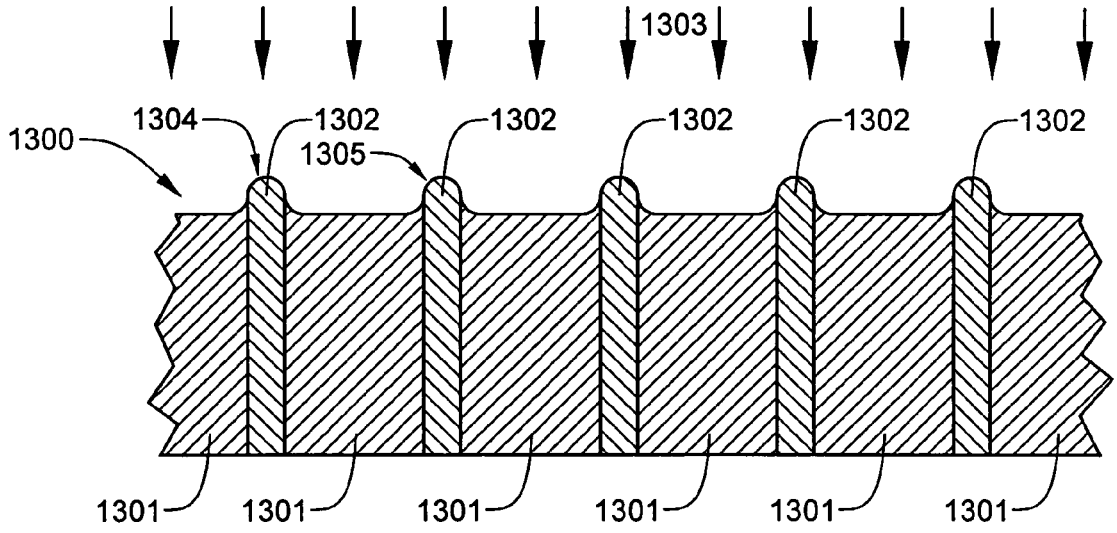
FIG. 13 is a cross-sectional view of a soundboard that has been textured by particle or bead blasting.

Referring now to FIG. 13, a textured soundboard 1300 has been created by removing-rather than compacting-earlywood growth material from the upper surface. Because the earlywood grain regions 1301 are less dense than the latewood grain regions 1302, the earlywood growth material will be removed at a faster rate than the latter when the surface is subjected to particle blasting. The particles may be sand, plastic beads or sublimable particles such as carbon dioxide pellets. The downward arrows 1303 represent the blasting process. The resulting soundboard 1300, although not considered to be the preferred embodiment of the invention, does have increased surface area. It will be noted that the absence of compressed earlygrowth material between adjacent pairs of latewood grain regions 1302 results in a soundboard that likely has less stiffness than the untreated soundboard. It will also be noted that the upper surface 1304 of each latewood growth has rounded shoulders 1305. This is a result of only partial selectivity in the blasting process. That is, both the earlygrowth regions 1301 and lategrowth regions 1302 are simultaneously abraded, but at different rates.

Figure 14:
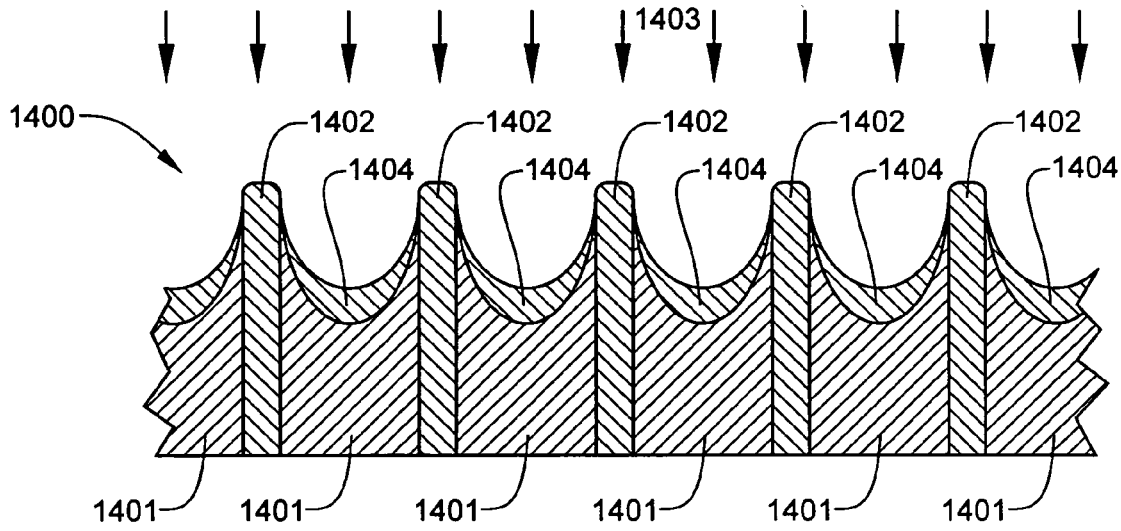
FIG. 14 is a cross-sectional view of a soundboard that has been textured by shot peening.

Referring now to FIG. 14, a textured soundboard 1400 has been created by using a shoot peening process. The difference between the process used for soundboards 1400 and 1300 reside in the projectiles that are used to collide with the soundboard surface, the energy used to accelerate the projectiles, and the particle angle of attack. For the shot peening process, generally smooth and spherical particles 1403 impact the soundboard 1400 orthogonal to its upper surface. The energy is not so great that material is removed from the upper surface, but rather simply compacted in regions 1404. As the earlygrowth regions 1401 are of lesser density than the lategrowth regions 1402, they are compacted at a faster rate than the lategrowth regions 1402.

Any of the textured soundboards illustrated in FIGS. 3, 6, 7, 8, 9, 10, 11, 12, 13 and 14 may be coated with at least one preservative coating. Such a preservative coating may be selected from the group consisting of varnish, lacquer, shellac, polyurethane resin and polyester resin.

Figure 15:
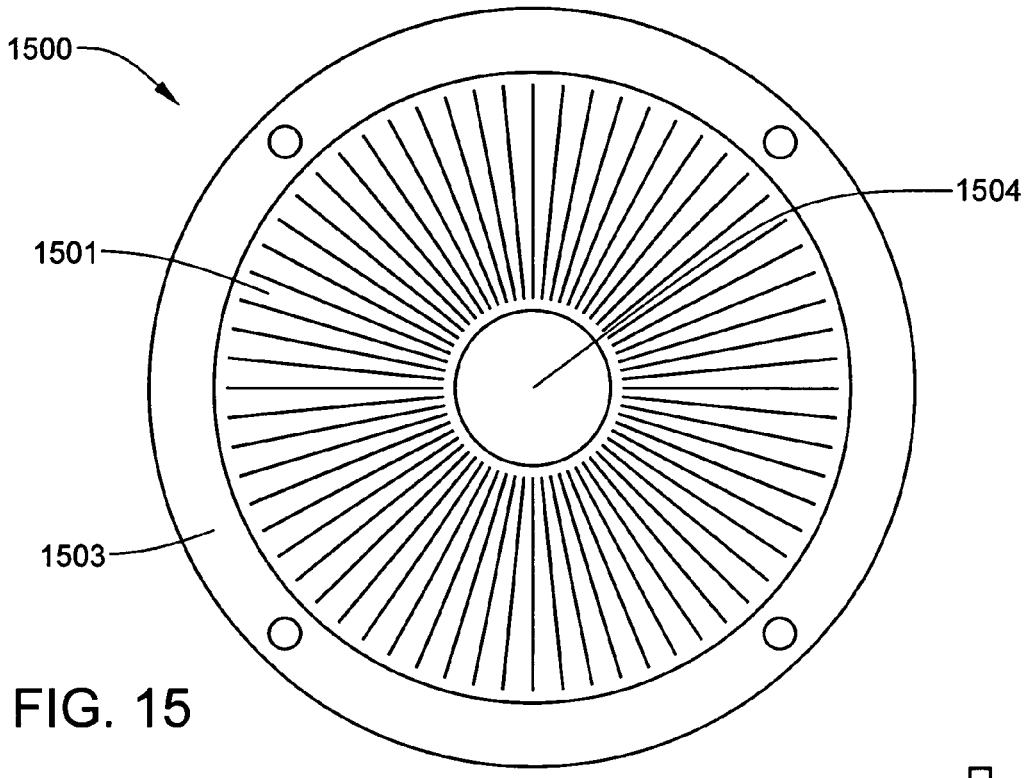
FIG. 15 is a front elevational view of a loudspeaker having a radially grooved speaker cone.
Figure 16:
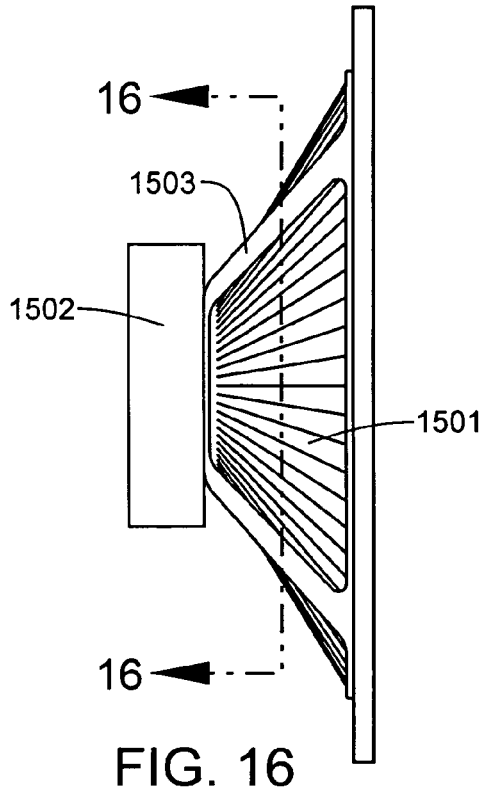
FIG. 16 is a side elevational view of the loudspeaker of FIG. 14.

Referring now to FIGS. 15 and 16, a loudspeaker 1500 manufactured in accordance with the present invention has a radially grooved speaker cone 1501 which increases its surface area as compared to a cone made of generally laminar material. The speaker cone 1501 is electromagnetically driven by an electromagnet assembly 1502 that is attached to both the frame 1503 of the loudspeaker 1500, and to the rear of the speaker cone 1501. The speaker cone 1501 is preferably molded from either cellulose fiber material or from a polymeric plastic material. The central diaphragm 1504 of the loudspeaker 1500 may also be molded from the same types of materials and provided with a textured surface to increase its surface area. The increase in surface area of the speaker cone 1501 and of the central diaphragm 1504 will increase the volume of sound generated thereby as compared to a conventional loudspeaker, all other parameters (e.g., the input current and driver efficiency) being equal.

Figure 17:
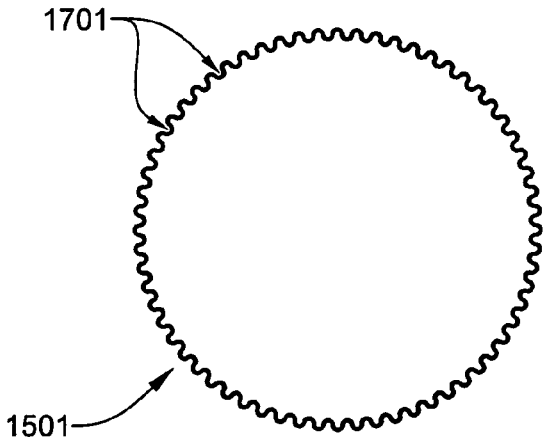
FIG. 17 is a thin slice view of the loudspeaker of FIGS. 14 and 15, taken through line 16-16 of FIG. 15.

Referring now to FIG. 17, the radial grooves 1701 in the speaker cone 1501 are clearly visible in this thin-slice view. Although only the radially-grooved pattern has been shown in a loudspeaker embodiment, it should be understood that this invention contemplates the use of any other pattern that can be stamped or molded on a laminar material. Such pattern may include a waffle pattern, random three-dimensional patterns, or a pattern of repeating geometric figures, such as the contiguous pyramids shown in FIG. 11. However, for a loudspeaker cone application, the pattern would be imprinted or molded on both sides of the laminar cone or diaphragm material, in the same manner that a paper fiber egg carton as a three-dimensional pattern on both upper and lower surfaces.

Figure 18:
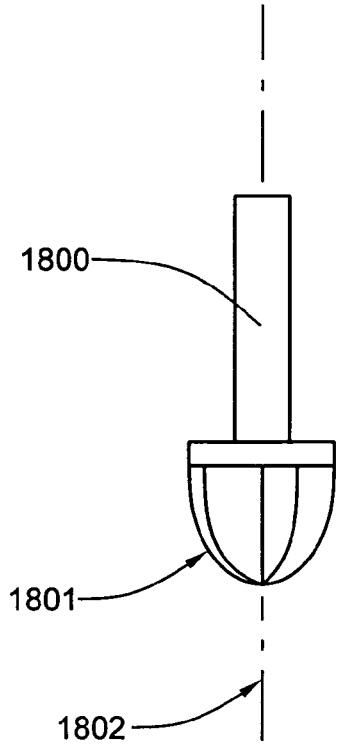
FIG. 18 is a router bit that may be used to make grooves of parabolic cross section in a soundboard.

Referring now to FIG. 18, a router bit 1800 having a parabolic tip 1801 may be rotated at high speed about its central axis 1802 to removed early growth material in a computer-controlled, optically-guided texturization operation. The technology for guiding and controlling such a cutting operation is well known in the art.

Figure 19:
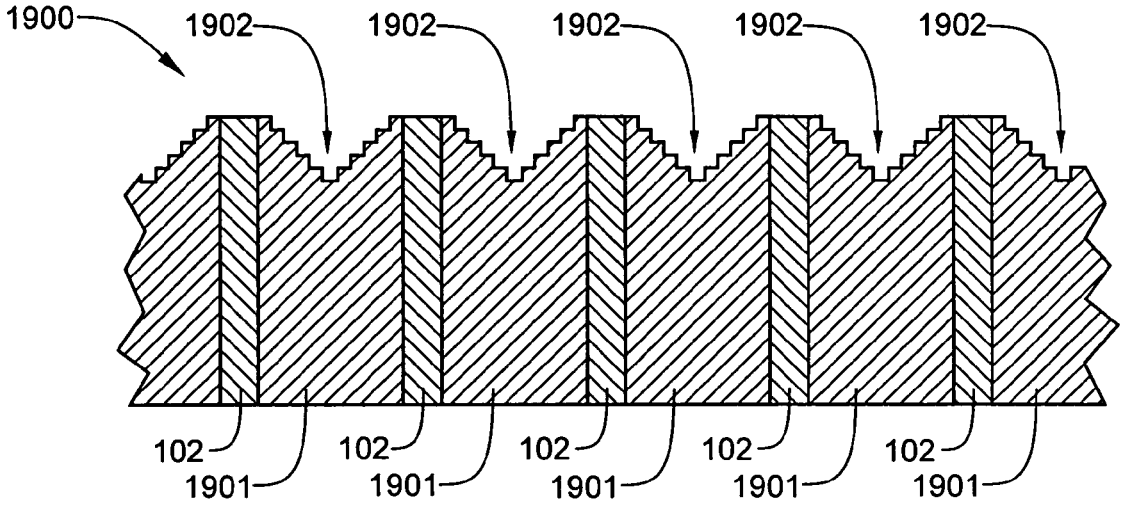
FIG. 19 is a textured soundboard on which earlygrowth material has been removed using a computer-controlled, optically-guided scanning laser.

Referring now to FIG. 19, a soundboard 1900 has been texturized using a computer-controlled, optically-guided scanning laser (not shown). The laser has removed (i.e., burned) material in a step-like fashion to create a series of stepped trenches 1902 in the earlywood regions 1901. The lategrowth regions 102 are untouched. The technology for guiding and controlling a laser burning operation is well known in the art.

Although only several embodiments of the invention have been disclosed herein, it will be obvious to those having ordinary skill in the art that changes and modifications may be made thereto without departing from the scope of the invention as hereinafter claimed.

RERERENCES

"Geometry, Proportion and the Art of Lutherie: A study of the use, and esthetic significance of geometry and numerical proportion in the design of European bowed and plucked string instruments in the $16^{th}$, $17^{th}$ and $18^{th}$ centuries." By Kevin Coates. Published by Oxford at the Clarendon Press, 1985, David Stanford, printer. 170 pp. Library of Congress ML755.c6 1983 787'.672 83-23611. ISBN 0-19-816139-5

"Violin-Making, As It Was and Is" By Edward Heron-Allen. Publisher: Best Books. ISBN: 0-72-225999-9, (January 2001)

"Art & Method of the Violin Maker: Principles and Practices, by Henry A Strobel. (Four Book Series for Violin Makers) Publisher: Henry Strobel, Violin Maker and Publisher. ISBN: 0-96-206735-0, 2 edition (December 1992)

"The Secrets of Stradivari—With the catalog of the Stradivaian Relics contained in the Civic Museum at Ala Ponzone of Cremona. (English Translation) Libreria del Convegno, Cremona 1979. Translated and Edited by Andrew Dipper and Christina Rivaroli. Printed in Cremona By Tipolito Padana Press. 284 pp.

"88 Keys: The Making of a Steinway Piano" by Miles Chapin, (Rodica Prato, Illustrator) Publisher: Clarkson N. Potter; 144 pages; ISBN: 0517703564; (September 1997)

"Theory and Practice in. Piano Construction" by William Braid White; Publisher: Dover Pubns; 160 pages ISBN: 0486231399; (June 1975).

"Piano Servicing, Tuning and Rebuilding: For the Professional, the Student, the Hobbyist" by Arthur A. Reblitz; Publisher: Vestal Press Ltd; 327 pages; ISBN: 1879511037; 2nd edition (Jan. 19, 1993)

What is claimed is:

1. A method of manufacturing a soundboard for a stringed musical instrument, said method comprising the steps of:

fashioning a soundboard from at least one piece of lumber having both earlywood and latewood grains; and texturing at least one surface of the soundboard by forming a plurality of grooves in the earlywood growth portions thereof.

2. The method of claim 1, wherein the lumber selected is quarter sawn.

3. The method of claim 1, wherein each groove is superimposed on an earlywood grain.

4. The method of claim 1, wherein at least one of said grooves is of generally parabolic cross section.

5. The method of claim 1, wherein at least one of said grooves is of generally semi-circular cross section.

6. The method of claim 1, wherein at least one of said grooves is of generally V-shaped cross section.

7. The method of claim 1, which further comprises the step of coating the textured surface with at least one preservative coating.

8. The method of claim 7, wherein said preservative coating is selected from the group consisting of varnish, lacquer, shellac, polyurethane resin and polyester resin.

9. The method of claim 1, wherein each groove is formed with a stylus.

10. The method of claim 1, wherein each groove is formed with a rotating disk tool.

11. The method of claim 1, wherein each groove is formed by a shot peening process.

12. The method of claim 1, wherein each groove is formed by a particle blasting process.

13. The method of claim 12, wherein the particles used for the particle blasting process are selected from the group consisting of sand, plastic beads and dry ice particles.

14. The method of claim 1, wherein each groove is formed with an optically-guided and computer-controlled router having a bit with the desired cross section that has about the same diameter as an earlywood grain.

15. The method of claim 1, wherein each groove is formed with an optically-guided, computer-controlled scanning laser.

16. A method of enhancing the resonance of a quarter-sawn wood panel intended as a vibrating sound source, said method comprising the step of compacting the earlywood grain on at least one surface of the panel to create a series of generally parallel grooves in said at least one surface.

17. The method of claim 16, wherein each groove has a generally semi-circular cross section.

18. The method of claim 16, wherein each groove has a generally parabolic cross section.

19. The method of claim 16, wherein each groove has a generally V-shaped cross section.

20. The method of claim 16, which further comprises the step of coating said at least one surface with at least one preservative coating.

21. The method of claim 20, wherein said preservative coating is selected from the group consisting of varnish, lacquer, shellac, polyurethane resin and polyester resin.

22. The method of claim 16, wherein each groove is formed with a stylus.

23. The method of claim 16, wherein each groove is formed with a rotating disk tool.

24. The method of claim 16, wherein each groove is formed by a shot peening process.

25. The method of claim 16, wherein each groove is formed by a particle blasting process.

26. The method of claim 25, wherein the particles used for the particle blasting process are selected from the group consisting of sand, plastic beads and dry ice particles.

27. The method of claim 16, wherein each groove is formed with an optically-guided and computer-controlled router having a bit with the desired cross section that has about the same diameter as an earlywood grain.

28. The method of claim 16, wherein each groove is formed with an optically-guided, computer-controlled scanning laser.

29. A method of treating a wooden soundboard of a stringed musical instrument to enhance its resonance, said method comprising the step of texturing at least one surface of the soundboard by forming a plurality of grooves in earlywood growth portions thereof.

30. The method of claim 29, wherein each groove is superimposed on an earlywood grain.

31. The method of claim 29, wherein at least one of said grooves has a cross-sectional profile chosen from the group consisting of generally parabolic, semi-circular, V-shaped, stepped-V-shaped and U-shaped.

32. The method of claim 29, wherein each groove is formed by a tool selected from the group consisting of styluses; rotating disk tools; optically-guided and computer-controlled lasers; and optically-guided and computer-controlled routers.

33. The method of claim 29, wherein each groove is formed by a particle bombardment process selected from the group of processes consisting of sand blasting, bead blasting, and sublimable particle blasting.

34. The method of claim 30, wherein each groove is formed by a shot peening process that compacts earlywood grain material on the surface of the soundboard.

35. A method for enhancing the resonance of a wood panel intended to function as a vibrating sound source, said method comprising the step texturing at least one major surface of the panel by forming a plurality of grooves in the earlywood growth portions thereof.

36. The method of claim 35, wherein said grooves are formed by compacting earlywood grain.

37. The method of claim 35, wherein compaction of the earlywood grain increases the stiffness of the earlywood grain sections, thereby increasing the stiffness of the entire panel.

38. The method of claim 35, wherein compaction of the earlywood grain increases the surface area of the panel, said increased surface area being the resulting sum of generally planar uncompacted regions and the sidewalls and floors of the grooves in said at least one major surface.

39. The method of claim 35, which further comprises the step of shaping the the latewood growth grains into rounded, flattened or pointed ridges.

* * * * *